US009665061B2

(12) United States Patent
Kimura et al.

(10) Patent No.: US 9,665,061 B2
(45) Date of Patent: May 30, 2017

(54) CLEANING BLADE

(71) Applicants: NOK CORPORATION, Tokyo (JP); SYNZTEC CO., LTD., Tokyo (JP)

(72) Inventors: Natsumi Kimura, Kanagawa (JP); Miyuki Abe, Kanagawa (JP); Toshihiro Higashira, Kanagawa (JP); Katsumi Abe, Kanagawa (JP)

(73) Assignees: NOK CORPORATION, Tokyo (JP); SYNZTEC CO., LTD., Tokyo (JP)

( * ) Notice: Subject to any disclaimer, the term of this patent is extended or adjusted under 35 U.S.C. 154(b) by 0 days.

(21) Appl. No.: 15/105,419

(22) PCT Filed: Dec. 15, 2014

(86) PCT No.: PCT/JP2014/083154
§ 371 (c)(1),
(2) Date: Jun. 16, 2016

(87) PCT Pub. No.: WO2015/093441
PCT Pub. Date: Jun. 25, 2015

(65) Prior Publication Data

US 2016/0313690 A1 Oct. 27, 2016

(30) Foreign Application Priority Data

Dec. 16, 2013 (JP) ..... 2013-259647

(51) Int. Cl.
*G03G 21/00* (2006.01)

(52) U.S. Cl.
CPC ..... *G03G 21/0017* (2013.01)

(58) Field of Classification Search
CPC ..... G03G 21/0017; G03G 2221/0005
See application file for complete search history.

(56) References Cited

U.S. PATENT DOCUMENTS

2009/0311017 A1* 12/2009 Ohmori ..... G03G 21/0017 399/350
2011/0135361 A1* 6/2011 Kabata ..... G03G 21/0017 399/350

(Continued)

FOREIGN PATENT DOCUMENTS

JP 57-178262 5/1981
JP 8-248851 9/1996

(Continued)

OTHER PUBLICATIONS

International Search Report, PCT/JP2014/083154, Mar. 24, 2015.

*Primary Examiner* — David M Gray
*Assistant Examiner* — Laura Roth
(74) *Attorney, Agent, or Firm* — Young & Thompson

(57) ABSTRACT

In a cleaning blade 1 having an elastic body 11, which is a molded article of a rubber material, the elastic body 11 having at least a surface-treated layer 12 formed at least on an abutting part with an object of contact, the surface-treated layer 12 is formed by impregnating the elastic body 11 with a surface treatment liquid which contains a bi-functional isocyanate compound, a tri-functional polyol, and an organic solvent, or with a surface treatment liquid which contains an organic solvent and an isocyanate-group-containing compound having an isocyanate group yielded through reaction between the bi-functional isocyanate compound and the tri-functional polyol, followed by curing; the ratio between an isocyanate group contained in the bi-functional isocyanate compound and a hydroxyl group contained in the tri-functional polyol (NCO group/OH group) is 1.0 to 1.5; and the surface-treated layer has a thickness of 10 μm to 100 μm.

4 Claims, 1 Drawing Sheet

(56) References Cited

U.S. PATENT DOCUMENTS

| | | | | |
|---|---|---|---|---|
| 2014/0064810 | A1* | 3/2014 | Iwamoto | G03G 21/0017 399/350 |
| 2015/0071678 | A1* | 3/2015 | Ikuno | G03G 15/75 399/111 |

FOREIGN PATENT DOCUMENTS

| | | |
|---|---|---|
| JP | 2004-280086 | 10/2004 |
| JP | 2007-052062 | 3/2007 |
| JP | 2009-025451 | 2/2009 |
| JP | 2011-186141 | 9/2011 |

* cited by examiner

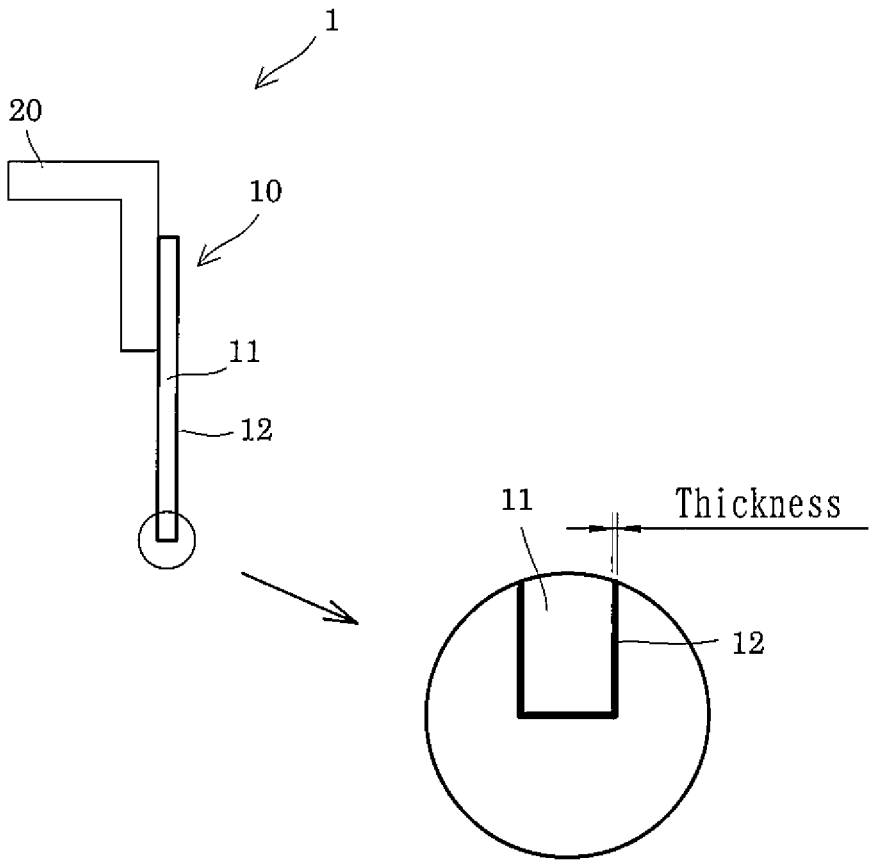
1
20
10
11
12
11
Thickness
12

CLEANING BLADE

TECHNICAL FIELD

The present invention relates to a cleaning blade for use in image forming apparatus such as electrophotographic copiers and printers, and toner-jet copiers and printers.

BACKGROUND ART

Generally, an electrophotographic process performs at least a cleaning process, an electric charging process, an exposure process, a development process, and a transfer process on an electrophotographic photoreceptor. These processes use a cleaning blade for removing remaining toner from the surface of a photosensitive drum to clean the surface, an electrically conductive roller for uniformly electrically charging the photoreceptor, a transfer belt for transfer of a toner image, etc. In view of plastic deformation and wear resistance, the cleaning blade is formed primarily of thermosetting polyurethane resin.

However, for example, in the case of use of a cleaning blade formed of polyurethane resin, a friction coefficient between a blade member and the photosensitive drum increases, and, in some cases, causing the following problems: the blade is turned up; the blade produces unusual noise; and a driving torque for the photosensitive drum must be increased. Also, in some cases, the following problem has occurred: the distal end of the cleaning blade is caught by the photosensitive drum, etc., to be stretched and cut, and is abrasively broken. These problems have been particularly marked in the case of a cleaning blade having low hardness; as a result, in some cases, the durability of the cleaning blade has been insufficient.

In order to solve these problems, conventionally, imparting high hardness and low friction to a contact portion of a polyurethane blade has been attempted. For example, the following method (refer to, for example, Patent Documents 1 to 3) has been proposed: the polyurethane blade is impregnated with an isocyanate compound for reacting a polyurethane resin and an isocyanate compound with each other such that high hardness is imparted only to the surface of the polyurethane resin blade and its vicinity, and low friction is imparted to the surface.

However, in order to impart required properties to the blade by the methods disclosed in Patent Documents 1 to 3, a polyurethane resin must be impregnated with a surface treatment liquid which contains an isocyanate compound at high concentration; accordingly, a surface-treated layer must be formed deep. An attempt to use a high-concentration surface treatment liquid and form the surface-treated layer deep involves a problem in that excess isocyanate is apt to remain on the blade surface; thus, a step of removing the excess isocyanate is required. By contrast, forming the surface-treated layer thin results in insufficient wear resistance, causing a problem of deterioration in cleaning performance.

PRIOR ART DOCUMENTS

Patent Documents

Patent Document 1: Japanese Patent Application Laid-Open (kokai) No. 2007-052062

Patent Document 2: Japanese Patent Application Laid-Open (kokai) No. 2009-025451

Patent Document 3: Japanese Patent Application Laid-Open (kokai) No. 2004-280086

SUMMARY OF THE INVENTION

Problems to be Solved by the Invention

The present invention has been conceived in view of the above circumstances, and an object of the invention is to provide a cleaning blade in which, in spite of a thin surface-treated layer, the surface-treated layer exhibits high hardness, low friction, and excellent wear resistance and which thus can maintain good cleaning performance over a long period of time.

Means for Solving the Problems

In one mode of the present invention for solving the above problems, there is provided a cleaning blade comprising an elastic body which is a molded article of a rubber material, the elastic body having a surface-treated layer formed at least on an abutting part with an object of contact, the cleaning blade being characterized in that the surface-treated layer is formed by impregnating the elastic body with a surface treatment liquid which contains a bi-functional isocyanate compound, a tri-functional polyol, and an organic solvent, or with a surface treatment liquid which contains an isocyanate-group-containing compound having an isocyanate produced as a result of reaction between the bi-functional isocyanate compound and the tri-functional polyol, and an organic solvent, followed by curing; the ratio between an isocyanate group contained in the bi-functional isocyanate compound and a hydroxyl group contained in the tri-functional polyol (NCO group/OH group) is 1.0 to 1.5; and the surface-treated layer has a thickness of 10 μm to 100 μm.

The invention enables provision of a cleaning blade in which, in spite of a thin surface-treated layer, the surface-treated layer exhibits high hardness, low friction, and excellent wear resistance and which thus can maintain good cleaning performance over a long period of time. Also, since the surface-treated layer has a thin thickness of 10 μm to 100 μm, remaining and post-drying deposition of the surface treatment liquid on the surface are minimized, thereby preventing application, onto the surface, of the isocyanate compound in an excessive amount.

Preferably, the bi-functional isocyanate compound has a molecular weight of 200 to 300, and the tri-functional polyol has a molecular weight of 150 or less.

Herewith, the reaction between the bi-functional isocyanate compound and the tri-functional polyol proceeds favorably, whereby the surface-treated layer can be efficiently formed.

Preferably, the elastic body is of polyurethane.

Herewith, by virtue of high affinity between polyurethane and the bi-functional isocyanate compound contained in the surface treatment liquid, the surface-treated layer can have higher hardness and lower friction.

Effects of the Invention

The present invention can provide a cleaning blade in which, in spite of a thin surface-treated layer, the surface-treated layer exhibits high hardness, low friction, and excellent wear resistance and which thus can maintain good cleaning performance over a long period of time. Also, since the surface-treated layer has a thin thickness of 10 μm to 100

μm, there can be prevented excessive application of the isocyanate compound to the surface.

BRIEF DESCRIPTION OF THE DRAWING

[The FIGURE] A cross-sectional view of an example cleaning blade.

MODES FOR CARRYING OUT THE INVENTION

Next will be described in detail the application of a cleaning blade according to the present invention to image forming apparatus.

(Embodiment 1)

As shown in the FIGURE, a cleaning blade 1 includes a blade body 10 and a support member 20, and the blade body (may also be called the cleaning blade in itself) 10 and the support member 20 are joined through an unillustrated adhesive. The blade body 10 is formed of an elastic body 11, which is a molded article of a rubber material. The elastic body 11 has a surface-treated layer 12 formed at a surface portion thereof. The surface-treated layer 12 is formed by impregnating a surface portion of the elastic body 10 with a surface treatment liquid, followed by curing. The surface-treated layer 12 may be formed at at least a portion of the elastic body 11 which comes into contact with an object of cleaning; however, in the present embodiment, the surface-treated layer 12 is formed over the entire surface of the elastic body 11.

A surface treatment liquid used for forming the surface-treated layer 12 is a mixed solution of a bi-functional isocyanate compound, a tri-functional polyol, and an organic solvent, or a mixed solution of an organic solvent and a prepolymer which is an isocyanate-group-containing compound having a terminal isocyanate group resulting from reaction between a bi-functional isocyanate compound and a tri-functional polyol. These surface treatment liquids are prepared as appropriate in view of wettability with respect to the elastic body 11, the degree of immersion, and the effect validity period of a surface treatment liquid.

In the surface treatment liquid, the ratio between an isocyanate group contained in the bi-functional isocyanate compound and a hydroxyl group contained in the tri-functional polyol (NCO group/OH group) is 1.0 to 1.5. When the ratio between an isocyanate group and a hydroxyl group (NCO group/OH group) is less than 1.0, unreacted polyol remains, causing whitening and softening. Also, when the ratio is greater than 1.5, unreacted isocyanate remains, causing browning. Thus, when the ratio between an isocyanate group and a hydroxyl group (NCO group/OH group) is less than 1.0 or greater than 1.5, the surface-treated layer fails to have high hardness and low friction, resulting in a failure to have good cleaning performance and wear resistance.

Also, the surface-treated layer 12 is formed at a surface portion of the elastic body 11 at a thickness of 10 μm to 100 μm, preferably 10 μm to 50 μm. Even though the thickness is a very thin one of about 1/10 that of the conventional surface-treated layer 12, the surface-treated layer 12 has high hardness, low friction, and excellent wear resistance. This is for the following reason: through use of a surface treatment liquid which contains a bi-functional isocyanate compound, a tri-functional polyol, and an organic solvent or use of a prepolymer produced as a result of reaction of the isocyanate and polyol, the reaction between the bi-functional isocyanate compound and the tri-functional polyol and the reaction between the prepolymer and the elastic body 11 proceed efficiently, whereby the surface-treated layer 12 of high crosslink density is formed at a surface portion of the elastic body 11. Since such a surface-treated layer 12 can be formed at a surface portion of the elastic body 11 without need to use a high-concentration surface treatment liquid, the isocyanate compound is not excessively applied to the surface of the elastic body, so that there is no need to employ a conventional step of removing an excess isocyanate compound.

Furthermore, preferably, the elastic modulus (herein, indentation elastic modulus (Young's modulus); the same also applies in the following description) of the surface-treated layer 12 is 40 MPa or less. If the elastic modulus of the surface-treated layer 12 is greater than 40 MPa, the surface-treated layer 12 fails to follow deformation of the elastic body 11, resulting in occurrence of chipping of the surface-treated layer 12.

Also, preferably, the elastic modulus of the elastic body 11 is 5 MPa to 20 MPa. If the elastic modulus of the elastic body 11 is less than 5 MPa, the torque of an object of contact; i.e., in the present embodiment, a photosensitive drum, increases, resulting in deterioration in the effect of filming suppression. Filming means a phenomenon of adhesion of toner to the photosensitive drum. If the elastic modulus of the elastic body 11 is greater than 20 MPa, sufficient contact fails to be established between the photosensitive drum and the cleaning blade. Furthermore, preferably, the difference in elastic modulus between the surface-treated layer 12 and the elastic body 11 is 3 MPa or more. If the difference in elastic modulus between the surface-treated layer 12 and the elastic body 11 is less than 3 MPa, the effect of filming suppression fails to be sufficiently yielded.

First will be described a surface treatment liquid formed of a mixed solution of a bi-functional isocyanate compound, a tri-functional polyol, and an organic solvent.

Examples of a bi-functional isocyanate compound used in preparation of the surface treatment liquid include 4,4'-diphenylmethane diisocyanate (MDI), isophorone diisocyanate (IPDI), 4,4'-dicyclohexylmethane diisocyanate (H-MDI), trimethylhexamethylene diisocyanate (TMHDI), tolylene diisocyanate (TDI), carbodiimide-modified MDI, polymethylene polyphenyl polyisocyanate, 3,3-dimethyldiphenyl-4,4'-diisocyanate (TODI), naphthylene diisocyanate (NDI), xylene diisocyanate (XDI), lysin diisocyanate methyl ester (LDI), dimethyl diisocyanate, and polymers and modified products thereof. Among bi-functional isocyanate compounds, preferably, one having a molecular weight of 200 to 300 is used. Among the above bi-functional isocyanate compounds, 4,4'-diphenyl methane diisocyanate (MDI) and 3,3-dimethyldiphenyl-4,4'-diisocyanate (TODI) have a molecular weight of 200 to 300. Through use of a bi-functional isocyanate compound having a molecular weight of 200 to 300, reaction with a tri-functional polyol proceeds consistently; a surface portion of the elastic body 11 is impregnated with the surface treatment liquid in a short period of time. Even though the surface-treated layer 12 is thin, the surface-treated layer 12 has high hardness and low friction.

Particularly when polyurethane is used as the elastic body 11, by virtue of high affinity between a bi-functional isocyanate compound and polyurethane, the surface-treated layer 12 and the elastic body 11 can be bonded together more strongly, and the surface-treated layer 12 can have higher hardness and lower friction. By contrast, when a tri-functional isocyanate compound is used, steric hindrance is large. As a result, a crosslinking reaction fails to proceed to a certain extent. Thus, a bi-functional isocyanate compound must be used because of its consistent reaction with a tri-functional polyol.

Examples of the tri-functional polyol include tri-functional aliphatic polyols, such as glycerin, 1,2,4-butanetriol, trimethylolethane (TME), trimethylolpropane (TMP), and 1,2,6-hexanetriol; polyether triols formed through addition of ethylene oxide, butylene oxide, etc., to tri-functional aliphatic polyols; and polyester triols formed through addition of lactone, etc., to tri-functional aliphatic polyols. Among tri-functional polyols, preferably, one having a molecular weight of 150 or less is used. Among the above tri-functional polyols, trimethylolpropane (TMP) has a molecular weight of 150 or less. Through use of a tri-functional polyol having a molecular weight of 150 or less, reaction with bi-functional isocyanate is increased in speed, and a high-hardness surface-treated layer can be yielded.

When a tri-functional polyol is contained in a surface treatment liquid, a tri-functional hydroxyl group reacts with an isocyanate group, thereby yielding the surface-treated layer 12 of high crosslinking density having a three-dimensional structure. Thus, even though a thin surface-treated layer 12 is formed by use of a low-concentration surface treatment liquid, the surface-treated layer 12 can have high hardness and low friction. Furthermore, a surface treatment liquid which contains a bi-functional isocyanate compound and a tri-functional polyol exhibits a long effect validity period as will be described later in the Examples and thus has excellent storage performance.

No particular limitation is imposed on the organic solvent, so long as the organic solvent dissolves a bi-functional isocyanate compound and a tri-functional polyol. However, an organic solvent having no active hydrogen, which is reactive with an isocyanate compound, is preferably used. Examples of such an organic solvent include methyl ethyl ketone (MEK), methyl isobutyl ketone (MIBK), tetrahydrofuran (THF), acetone, ethyl acetate, butyl acetate, toluene, and xylene. The lower the boiling point of an organic solvent, the higher the solubility of a target in the organic solvent, whereby drying after impregnation can be accelerated, and processing can be performed uniformly. The organic solvent to be used is selected as appropriate from these organic solvents according to the degree of swelling of the elastic body 11 and is preferably methyl ethyl ketone (MEK), acetone, or ethyl acetate.

In the case of using a mixed solution of a bi-functional isocyanate compound and a tri-functional polyol as a surface treatment liquid, when a surface portion of the elastic body 11 is impregnated with the surface treatment liquid, followed by curing, the bi-functional isocyanate compound and a tri-functional polyol react to form a prepolymer. When the prepolymer is cured, an intact terminal isocyanate group reacts with the elastic body 11 to form the surface-treated layer 12.

Meanwhile, a surface treatment liquid which contains an isocyanate-group-containing compound having an isocyanate group produced as a result of reaction between a bi-functional isocyanate compound and a tri-functional polyol is formed as follows: the above-mentioned bi-functional isocyanate compound and tri-functional polyol are reacted in advance with each other to thereby synthesize a prepolymer; i.e., an isocyanate-group-containing compound having a terminal isocyanate group, and the prepolymer and an organic solvent are mixed to form a surface treatment liquid. In this case, in reacting a bi-functional isocyanate compound and a tri-functional polyol with each other, the ratio between an isocyanate group contained in the bi-functional isocyanate compound and a hydroxyl group contained in the tri-functional polyol (NCO group/OH group) is 1.0 to 1.5 as in the aforementioned case.

Such a reaction of a bi-functional isocyanate compound and a tri-functional polyol into a prepolymer may take place in the course of impregnating a surface portion of the elastic body 11 with a surface treatment liquid. However, the extent of reaction may be controlled through adjustment of a reaction temperature, a reaction time, and aging conditions. The reaction to form the prepolymer is generally performed at a surface treatment liquid temperature of 5° C. to 35° C. and a humidity of 20% to 70%.

In any case, a crosslinking agent, a catalyst, a curing agent, etc., may be added to a surface treatment liquid as needed. The amounts of a bi-functional isocyanate compound and a tri-functional polyol, which are active components, or the bi-functional isocyanate compound concentration in reacting the bi-functional isocyanate compound and the tri-functional polyol with each other may be selected as appropriate in view of solubility in an organic solvent and impregnation performance into a surface portion. However, the amounts (concentrations) are preferably 3% by mass to 30% by mass, more preferably 5% by mass to 20% by mass.

Also, the elastic body 11 is formed of a matrix having active hydrogen. Examples of the matrix having active hydrogen include matrices in which polyurethane, epichlorohydrin rubber, nitrile rubber (NBR), styrene rubber (SBR), chloroprene rubber, or EPDM is employed as a rubber material. Among these rubber materials, a rubber material of polyurethane is preferred in view of easy reaction with a bi-functional isocyanate compound. An example of the polyurethane rubber material is predominantly from at least one selected from among aliphatic polyether, polyester, and polycarbonate. Specifically, a polyurethane rubber material is predominantly formed from polyol which contains at least one selected from among aliphatic polyether, polyester, and polycarbonate and is urethane-bonded. Preferably, the rubber material is formed of polyether-base polyurethane, polyester-base polyurethane, polycarbonate-base polyurethane, or the like. Also, in place of urethane bond, polyamide bond, ester bond, or the like can be employed for forming the elastic body. Furthermore, thermoplastic elastomers such as polyether amide and polyether-ester can also be used. Also, a rubber material having active hydrogen serving as a filler and a plasticizer may be used together with or in place of a rubber material having active hydrogen.

The surface portion of such an elastic body 11 is impregnated with a surface treatment liquid and then cured, thereby forming the surface-treated layer 12 at the surface portion of the elastic body 11. No particular limitation is imposed on the method in which a surface portion of the elastic body 11 is impregnated with a surface treatment liquid, followed by curing. For example, there is a method in which the elastic body 11 is immersed in a surface treatment liquid, followed by heating or a method in which a surface treatment liquid is applied, by spraying or the like, to the surface of the elastic body 11 for permeation into the surface, followed by heating. Also, no particular limitation is imposed on the heating method; for example, there are a heating process, forced drying, and natural drying.

Specifically, in the case of using a mixed solution of a bi-functional isocyanate compound, a tri-functional polyol, and an organic solvent as a surface treatment liquid, formation of the surface-treated layer 12 proceeds as follows: in the course of impregnating a surface portion of the elastic body 11 with the surface treatment liquid, a bi-functional isocyanate compound and a tri-functional polyol react with each other into a prepolymer, and the prepolymer is cured; furthermore, an isocyanate group reacts with the elastic body 11.

In the case of using a prepolymer as a surface treatment liquid, formation of the surface-treated layer 12 proceeds as follows: a surface portion of the elastic body 11 is impregnated with the surface treatment liquid, followed by curing, and an isocyanate group reacts with the elastic body 11.

No particular limitation is imposed on the region of the elastic body 11 where a surface-treated layer is formed, so long as the region encompasses at least a region to come into contact with an object of contact. For example, the surface-treated layer may be formed only at a distal end portion of the elastic body 11 or may be formed in the entirety of the elastic body 11. Also, in the form of a cleaning blade formed by bonding the support member 20 to the elastic body 11, the surface-treated layer may be formed only at a distal end portion or at a surface portion of the entire elastic body. In a further alternative mode, a surface-treated layer may be formed at one side, both sides, or the entire surface of a rubber-molded article, and then the rubber-molded article is cut into a blade shape to thereby yield the elastic body 11.

According to the present invention, a surface portion of the elastic body 11 is impregnated with a surface treatment liquid which contains a bi-functional isocyanate compound, a tri-functional polyol, and an organic solvent, the ratio between an isocyanate group and a hydroxyl group (NCO group/OH group) being 1.0 to 1.5, or with a prepolymer produced as a result of reaction between the bi-functional isocyanate compound and the tri-functional polyol, followed by curing, whereby a surface-treated layer which, in spite of a very thin thickness of 10 μm to 100 μm, preferably 10 μm to 50 μm, has high hardness and low friction can be formed at a surface portion of the elastic body 11. A cleaning blade having such a surface-treated layer exhibits excellent wear resistance and can maintain good cleaning performance and filming suppression over a long period of time. Also, since the surface-treated layer is thin, there can be prevented excess application of an isocyanate compound to the surface of the elastic body.

EXAMPLES

The present invention will next be described by way of examples, which should not be construed as limiting the invention.

Example 1

(Manufacture of Rubber Elastic Body)

Ccaprolactone-base polyol (molecular weight 2,000) (100 parts by mass) was reacted with 4,4'-diphenylmethane diisocyanate (MDI) (38 parts by mass) at 115° C. for 20 minutes. Then, 1,4-butanediol (6.1 parts by mass) and trimethylolpropane (2.6 parts by mass) were mixed in as a crosslinking agent, and the resultant mixture was thermally cured in a mold maintained at 140° C. for 40 minutes. After molding, the molded article was cut into rubber elastic bodies each having a width of 12.3 mm, a thickness of 2.0 mm, and a length of 324 mm. The yielded rubber elastic body was found to have an elastic modulus of 10.0 MPa.

(Preparation of Surface Treatment Liquid)

MDI (product of Nippon Polyurethane Industry Co., Ltd., molecular weight 250.25) serving as a bi-functional isocyanate compound, TMP (product of MITSUBISHI GAS CHEMICAL COMPANY, INC., molecular weight 134.17) serving as a tri-functional polyol, and MEK serving as an organic solvent were mixed such that the ratio between an isocyanate group and a hydroxyl group (NCO group/OH group) was adjusted to 1.0, thereby preparing a surface treatment liquid having a concentration of 5% by mass. Notably, the surface treatment liquid concentration (% by mass) is the percentage of the total mass of the isocyanate compound and the polyol to the entire mass of the surface treatment liquid.

(Surface Treatment of Rubber Elastic Body)

While the surface treatment liquid was maintained at 23° C., the rubber elastic body was immersed in the surface treatment liquid for 0.5 minutes and was then heated for 1 hour in an oven maintained at 50° C. This process yielded a rubber elastic body having a 10 μm-thickness surface-treated layer formed at a surface portion thereof. Subsequently, the rubber elastic body was bonded to a support member, thereby yielding a cleaning blade.

The thickness of the surface-treated layer was measured by the following procedure according to JIS Z2255 and ISO14577 by means of a dynamic ultramicro hardness meter supplied by Shimadzu Corporation. First, the surface hardness of the rubber elastic body was measured; then, the surface-treated rubber elastic body was sectioned; a change in hardness was measured from the surface of the section toward the interior of the rubber elastic body; there was measured the distance from the surface at which the amount of change in hardness was 30% or less with respect to the hardness at a distance of 10 μm from the surface; and the measured distance was taken as the thickness of the surface-treated layer.

Example 2

A rubber elastic body was obtained by the procedure similar to that of Example 1. The rubber elastic body was surface-treated by the procedure similar to that of Example 1 except that the rubber elastic body was immersed, for one minute, in the surface treatment liquid having a concentration of 10% by mass and prepared by mixing the ingredients such that the ratio between an isocyanate group and a hydroxyl group (NCO group/OH group) was 1.2. This process yielded a rubber elastic body having a 30 μm-thickness surface-treated layer formed at a surface portion thereof. Subsequently, the rubber elastic body was bonded to a support member, thereby yielding a cleaning blade.

Example 3

A rubber elastic body was obtained by the procedure similar to that of Example 1. The rubber elastic body was surface-treated by the procedure similar to that of Example 2 except that the rubber elastic body was immersed in a surface treatment liquid for five minutes. This process yielded a rubber elastic body having a 80 μm-thickness surface-treated layer formed at a surface portion thereof. Subsequently, the rubber elastic body was bonded to a support member, thereby yielding a cleaning blade.

Example 4

A rubber elastic body was obtained by the procedure similar to that of Example 1. The rubber elastic body was surface-treated by the procedure similar to that of Example 2 except that the rubber elastic body was immersed in a surface treatment liquid for 10 minutes. This process yielded a rubber elastic body having a 100 μm-thickness surface-treated layer formed at a surface portion thereof. Subsequently, the rubber elastic body was bonded to a support member, thereby yielding a cleaning blade.

Example 5

A rubber elastic body was obtained by the procedure similar to that of Example 1. The rubber elastic body was surface-treated by the procedure similar to that of Example 1 except that the rubber elastic body was immersed, for one minute, in a surface treatment liquid having a concentration of 20% by mass and prepared by mixing the ingredients such that the ratio between an isocyanate group and a hydroxyl group (NCO group/OH group) was 1.5. This process yielded a rubber elastic body having a 50 μm-thickness surface-treated layer formed at a surface portion thereof. Subsequently, the rubber elastic body was bonded to a support member, thereby yielding a cleaning blade.

Example 6

A rubber elastic body was obtained by the procedure similar to that of Example 1. The rubber elastic body was surface-treated by the procedure similar to that of Example 2 except for use of a surface treatment liquid which contained TME (product of MITSUBISHI GAS CHEMICAL COMPANY, INC., molecular weight 120.15) in place of TMP. This process yielded a rubber elastic body having a 30 μm-thickness surface-treated layer formed at a surface portion thereof. Subsequently, the rubber elastic body was bonded to a support member, thereby yielding a cleaning blade.

Example 7

A rubber elastic body was obtained by the procedure similar to that of Example 1. The rubber elastic body was surface-treated by the procedure similar to that of Example 2 except for use of a surface treatment liquid which contained glycerin (product of KANTO CHEMICAL CO., INC., molecular weight 92.09) in place of TMP. This process yielded a rubber elastic body having a 30 μm-thickness surface-treated layer formed at a surface portion thereof. Subsequently, the rubber elastic body was bonded to a support member, thereby yielding a cleaning blade.

Comparative Example 1

A rubber elastic body was obtained by the procedure similar to that of Example 1. The rubber elastic body was surface-treated by the procedure similar to that of Example 2 except that the rubber elastic body was immersed in a surface treatment liquid having a concentration of 20% by mass for 30 minutes. This process yielded a rubber elastic body having a 120 μm-thickness surface-treated layer formed at a surface portion thereof. Subsequently, the rubber elastic body was bonded to a support member, thereby yielding a cleaning blade.

Comparative Example 2

A rubber elastic body was obtained by the procedure similar to that of Example 1. The rubber elastic body was surface-treated by the procedure similar to that of Example 2 except that the rubber elastic body was immersed in a surface treatment liquid having a concentration of 30% by mass for 20 minutes. This process yielded a rubber elastic body having a 150 μm-thickness surface-treated layer formed at a surface portion thereof. Subsequently, the rubber elastic body was bonded to a support member, thereby yielding a cleaning blade.

Comparative Example 3

A rubber elastic body was obtained by the procedure similar to that of Example 1. The rubber elastic body was surface-treated by the procedure similar to that of Example 2 except that the rubber elastic body was immersed in a surface treatment liquid having a concentration of 3% by mass for 0.1 minute. This process yielded a rubber elastic body having a 5 μm-thickness surface-treated layer formed at a surface portion thereof. Subsequently, the rubber elastic body was bonded to a support member, thereby yielding a cleaning blade.

Comparative Example 4

A rubber elastic body was obtained by the procedure similar to that of Example 1. The rubber elastic body was surface-treated by the procedure similar to that of Example 2 except for use of a surface treatment liquid prepared by mixing the ingredients such that the ratio between an isocyanate group and a hydroxyl group (NCO group/OH group) was 0.9. This process yielded a rubber elastic body having a 30 μm-thickness surface-treated layer formed at a surface portion thereof. Subsequently, the rubber elastic body was bonded to a support member, thereby yielding a cleaning blade.

Comparative Example 5

A rubber elastic body was obtained by the procedure similar to that of Example 1. The rubber elastic body was surface-treated by the procedure similar to that of Example 2 except for use of a surface treatment liquid prepared by mixing the ingredients such that the ratio between an isocyanate group and a hydroxyl group (NCO group/OH group) was 1.7. This process yielded a rubber elastic body having a 30 μm-thickness surface-treated layer formed at a surface portion thereof. Subsequently, the rubber elastic body was bonded to a support member, thereby yielding a cleaning blade.

Comparative Example 6

A rubber elastic body was obtained by the procedure similar to that of Example 1. The rubber elastic body was surface-treated by the procedure similar to that of Example 2 except for use of a surface treatment liquid which contained 1,3-propanediol (PDO) (product of KANTO CHEMICAL CO., INC., molecular weight 76.09) in place of TMP. This process yielded a rubber elastic body having a 30 μm-thickness surface-treated layer formed at a surface portion thereof. Subsequently, the rubber elastic body was bonded to a support member, thereby yielding a cleaning blade.

Comparative Example 7

A rubber elastic body was obtained by the procedure similar to that of Example 1. The rubber elastic body was surface-treated by the procedure similar to that of Example 2 except for use of a surface treatment liquid which did not contain a polyol, but contained polyisocyanate (trade name: MILLINATE MR-400, product of Nippon Polyurethane Industry Co., Ltd.) and had a polyisocyanate concentration of 10% by mass. This process yielded a rubber elastic body having a 30 μm-thickness surface-treated layer formed at a surface portion thereof. Subsequently, the rubber elastic body was bonded to a support member, thereby yielding a cleaning blade.

Comparative Example 8

A rubber elastic body was obtained by the procedure similar to that of Example 1. The rubber elastic body was surface-treated by the procedure similar to that of Comparative Example 7 except for use of a surface treatment liquid having a polyisocyanate concentration of 30% by mass. This process yielded a rubber elastic body having a 200 μm-thickness surface-treated layer formed at a surface portion thereof. Subsequently, the rubber elastic body was bonded to a support member, thereby yielding a cleaning blade.

Comparative Example 9

A rubber elastic body was obtained by the procedure similar to that of Example 1. The rubber elastic body was not surface-treated and then was bonded to a support member, thereby yielding a cleaning blade.

The rubber elastic bodies or the cleaning blades obtained in Examples 1 to 7 and Comparative Examples 1 to 9 were measured, by the following methods, in terms of coefficient of dynamic friction, indentation elasticity modulus of a surface-treated layer, surface hardness, and surface roughness to evaluate cleaning performance, filming suppression, wear resistance, appearance, and the effect validity period of a surface treatment liquid.

Test Example 1

<Measurement of Coefficient of Dynamic Friction>

By use of a tester supplied by SHINTO Scientific Co., Ltd., and a SUS304 steel ball having a diameter of 10 mm as a counter material, the coefficient of dynamic friction was measured in accordance with JIS K7125 and P8147 and ISO8295 at a moving speed of 50 mm/minute, a load of 0.49 N, and an amplitude of 50 mm.

Test Example 2

<Measurement of Indentation Elasticity Modulus>

By use of a dynamic ultramicro hardness meter supplied by Shimadzu Corporation, the indentation elasticity modulus of a surface-treated layer was measured by a loading-unloading test conducted in accordance with ISO14577 at a retention time of 5 seconds, a maximum test load of 0.98 N, and a loading speed of 0.14 N/s.

Test Example 3

<Measurement of Surface Hardness>

By use of a dynamic ultramicro hardness meter supplied by Shimadzu Corporation, surface hardness was measured by an under-pressure indentation test conducted in accordance with JIS Z2255 and ISO14577 at a loading speed of 1.4 mN/s and a measuring depth of 10 μm.

Test Example 4

<Measurement of Surface Roughness>

By use of SURFCOM1400A supplied by Toyo Seimitsu Co., Ltd., the rubber elastic body surface was measured for the average roughness Rz of 10 points of measurement in accordance with JIS B0601-1994 at a moving speed of 0.15 mm/s, a cutoff wavelength of 0.8 mm, a loading speed of 1.4 mN/s, and a measuring depth of 10 μm.

Test Example 5

<Evaluation of Cleaning Performance>

After one million sheets were printed by use of TASKalfa5550ci supplied by Kyocera with a blade incorporated in a cartridge, if toner slipping-off did not exist, cleaning performance was evaluated as "Good;" if toner slipping-off existed to a certain extent within tolerance, cleaning performance was evaluated as "Fair;" and if toner slipping-off existed, cleaning performance was evaluated as "Poor."

Test Example 6

<Evaluation of Filming Suppression>

After one million sheets were printed by use of TASKalfa5550ci supplied by Kyocera with a blade incorporated in a cartridge, if toner fixation did not exist, filming suppression was evaluated as "Good;" if toner fixation existed to a certain extent within tolerance, filming suppression was evaluated as "Fair;" and if toner fixation existed, filming suppression was evaluated as "Poor."

Test Example 7

<Evaluation of Wear Resistance>

After one million sheets were printed by use of TASKalfa5550ci supplied by Kyocera with a blade incorporated in a cartridge, if chips and wear did not exist, wear resistance was evaluated as "Good;" if very fine chips existed within tolerance, wear resistance was evaluated as "Fair;" and if chips or wear existed, wear resistance was evaluated as "Poor."

Test Example 8

<Evaluation of Appearance>

After one million sheets were printed by use of TASKalfa5550ci supplied by Kyocera with a blade incorporated in a cartridge, if uneven processing did not exist, appearance was evaluated as "Good;" if uneven processing existed to a certain extent within tolerance, appearance was evaluated as "Fair;" and if uneven processing existed, appearance was evaluated as "Poor."

Test Example 9

<Evaluation of Effect Validity Period of Surface Treatment Liquid>

A surface treatment liquid was prepared in an amount of 400 g and sealed in a 500 mL container; then, the container was stored at a storage temperature of 40° C. to measure the number of days before appearance abnormality arises; if appearance abnormality did not arise for two days or more, the effect validity period of the surface treatment liquid was evaluated as "Good;" if a certain appearance abnormality within tolerance arose in less than two days, the effect validity period was evaluated as "Fair;" and if appearance abnormality arose in less than two days, the effect validity period was evaluated as "Poor."

<Test Results>

Table 1 shows the results of Test Examples 1 to 9. As shown in Table 1, in Examples 1 to 7 in which the surface treatment liquid contains a bi-functional isocyanate compound and a tri-functional polyol, the ratio between an isocyanate group and a hydroxyl group (NCO group/OH group) in the surface treatment liquid is 1.0 to 1.5, and the surface-treated layer has a thickness of 10 μm to 100 μm, cleaning performance, filming suppression, wear resistance, appearance, and the effect validity period of the surface treatment liquid are all evaluated as Good. Also, the coefficient of dynamic friction, indentation elasticity modulus, surface hardness, and surface roughness assume such respective values as to sufficiently endure practical use.

In Comparative Examples 1 and 2 in which, even though the surface treatment liquid contains a bi-functional isocyanate compound and a tri-functional polyol, and the ratio between an isocyanate group and a hydroxyl group falls within a predetermined range, the thickness of the surface-treated layer is greater than 100 μm, surface hardness and indentation elasticity modulus are high, cleaning performance and appearance are evaluated as Poor, and wear resistance is evaluated as Fair. In Comparative Example 3 in which the surface-treated layer has a thin thickness of 5 μm, the coefficient of dynamic friction is slightly high, and filming suppression and wear resistance are evaluated as Poor.

In Comparative Example 4 in which, even though the surface treatment liquid contains a bi-functional isocyanate compound and a tri-functional polyol, and the thickness of the surface-treated layer falls within a predetermined range, the ratio between an isocyanate group and a hydroxyl group is less than 1.0, the coefficient of dynamic friction is slightly high, and cleaning performance, filming suppression, wear resistance, and appearance are evaluated as Poor; and, in Comparative Example 5 in which the ratio is greater than 1.5, cleaning performance, wear resistance, and appearance are evaluated as Poor.

In Comparative Example 6 using the surface treatment liquid which contains a bi-functional polyol as a polyol, cleaning performance, wear resistance, and the effect validity period of the surface treatment liquid are evaluated as Fair. In Comparative Examples 7 and 8 using the surface treatment liquid which contains only polyisocyanate, and in Comparative Example 9 in which surface treatment is not performed, at least two or more of cleaning performance, filming suppression, wear resistance, appearance, and the effect validity period of the surface treatment liquid are evaluated as Poor or Fair.

The above-mentioned results have revealed that by means of using a surface treatment liquid which contains a bi-functional isocyanate compound and a tri-functional polyol and employing the ratio between an isocyanate group and a hydroxyl group in the surface treatment liquid and the thickness of a surface-treated layer which fall within respectively predetermined ranges, cleaning performance, filming suppression, wear resistance, appearance, and the effect validity period of the surface treatment liquid can be reliably improved. A cleaning blade having such a rubber elastic body exhibits high hardness, low friction, and excellent wear resistance, even though the surface-treated layer is thin, and thus can maintain good cleaning performance over a long period of time and provide high reliability.

TABLE 1

| | | Ex. 1 | Ex. 2 | Ex. 3 | Ex. 4 | Ex. 5 | Ex. 6 | Ex. 7 | Com. Ex. 1 | Com. Ex. 2 | Com. Ex. 3 | Com. Ex. 4 | Com. Ex. 5 | Com. Ex. 6 | Com. Ex. 7 | Com. Ex. 8 | Com. Ex. 9 |
|---|---|---|---|---|---|---|---|---|---|---|---|---|---|---|---|---|---|
| Composition | Polyol | TMP (tri-functional) | | | | | TME (tri-functional) | Glycerin (tri-functional) | TMP (tri-functional) | | | | | PDO (bi-functional) | — | — | — |
| | Isocyanate compound | MDI (bi-functional) | | | | | | | | | | | | | polyisocyanate | | — |
| | NCO group/OH group | 1.0 | 1.2 | 1.2 | 1.2 | 1.5 | 1.2 | 1.2 | 1.2 | 1.2 | 1.2 | 0.9 | 1.7 | 1.2 | — | — | — |
| Processing conditions | Surface-treated layer (μm) | 10 | 30 | 80 | 100 | 50 | 30 | 30 | 120 | 150 | 5 | 30 | 30 | 30 | 30 | 200 | — |
| | Concentration (% by mass) | 5 | 10 | 10 | 10 | 20 | 10 | 10 | 20 | 30 | 3 | 10 | 10 | 10 | 10 | 30 | — |
| | Immersion time (min) | 0.5 | 1 | 5 | 10 | 1 | 1 | 1 | 30 | 20 | 0.1 | 1 | 1 | 1 | 1 | 1 | — |
| Evaluation | Coefficient of dynamic friction | 1.5 | 1.3 | 1.1 | 1.0 | 1.0 | 1.2 | 1.4 | 0.8 | 0.7 | 2.3 | 2.0 | 0.9 | 1.4 | 2.5 | 2.0 | 3.5 |
| | Indentation elasticity modulus (MPa) | 18 | 22 | 25 | 27 | 45 | 24 | 22 | 55 | 63 | 16 | 17 | 21 | 28 | 17 | 26 | 15 |
| | Surface hardness (mN/μm$^2$) | 0.17 | 0.18 | 0.20 | 0.21 | 0.23 | 0.20 | 0.18 | 0.26 | 0.28 | 0.16 | 0.17 | 0.18 | 0.20 | 0.16 | 0.19 | 0.15 |
| | Surface roughness Rz (μm) | 0.4 | 0.3 | 0.4 | 0.4 | 0.3 | 0.3 | 0.3 | 1.5 | 1.3 | 0.4 | 1.5 | 1.1 | 0.4 | 0.5 | 2.2 | 0.4 |
| | Cleaning performance | Good | Good | Good | Good | Good | Good | Good | Poor | Poor | Good | Poor | Poor | Fair | Good | Poor | Good |
| | Filming suppression | Good | Good | Good | Good | Good | Good | Good | Good | Good | Poor | Poor | Good | Good | Poor | Good | Poor |
| | Wear resistance | Good | Good | Good | Good | Good | Good | Good | Fair | Fair | Poor | Poor | Poor | Fair | Poor | Good | Poor |
| | Appearance | Good | Good | Good | Good | Good | Good | Good | Poor | Poor | Good | Poor | Poor | Good | Good | Poor | Good |
| | Effect | Good | Good | Good | Good | Good | Good | Good | Good | Fair | Good | Good | Good | Fair | Good | Fair | — |
| | validity period of surface treatment liquid | 14 days | 6 days | 6 days | 6 days | 3 days | 4 days | 6 days | 3 days | 1 day | 14 days | 6 days | 6 days | 1 day | 6 days | 1 day | |

INDUSTRIAL APPLICABILITY

The cleaning blade according to the present invention may be applied to cleaning blades, electrically conductive rollers, transfer belts, etc. for use in image forming apparatus such as electrophotographic copiers and printers and toner-jet copiers and printers and may also be used in other applications. Other applications are, for example, rubber parts such as seal parts, industrial rubber hoses, industrial rubber belts, wipers, automotive weather strips, and glass runs.

DESCRIPTION OF REFERENCE NUMERALS

1: cleaning blade
10: blade body
11: elastic body
12: surface-treated layer
20: support member

The invention claimed is:

1. A cleaning blade comprising an elastic body which is a molded article of a rubber material, the elastic body having a surface-treated layer formed at least on an abutting part with an object of contact, the cleaning blade being characterized in that the surface-treated layer is formed by impregnating the elastic body with a surface treatment liquid which contains a bi-functional isocyanate compound, a tri-functional polyol, and an organic solvent, or with a surface treatment liquid which contains an organic solvent and an isocyanate-group-containing compound having an isocyanate group produced as a result of reaction between the bi-functional isocyanate compound and the tri-functional polyol, followed by curing;

the ratio between an isocyanate group contained in the bi-functional isocyanate compound and a hydroxyl group contained in the tri-functional polyol (NCO group/OH group) is 1.0 to 1.5; and the surface-treated layer has a thickness of 10 μm to 100 μm.

2. A cleaning blade according to claim 1, wherein the bi-functional isocyanate compound has a molecular weight of 200 to 300, and the tri-functional polyol has a molecular weight of 150 or less.

3. A cleaning blade according to claim 1, wherein the elastic body is of polyurethane.

4. A cleaning blade according to claim 2, wherein the elastic body is of polyurethane.

* * * * *